US009069284B2

(12) United States Patent
Shimizu et al.

(10) Patent No.: US 9,069,284 B2
(45) Date of Patent: Jun. 30, 2015

(54) IMAGE FORMING APPARATUS AND POWDER TRANSPORT UNIT

(71) Applicants: Yoshiyuki Shimizu, Osaka (JP); Tomohiro Kubota, Osaka (JP); Shoh Tsuritani, Osaka (JP); Manabu Hamada, Osaka (JP); Masato Tsuji, Osaka (JP); Masanari Fujita, Osaka (JP); Naoki Nakatake, Hyogo (JP)

(72) Inventors: Yoshiyuki Shimizu, Osaka (JP); Tomohiro Kubota, Osaka (JP); Shoh Tsuritani, Osaka (JP); Manabu Hamada, Osaka (JP); Masato Tsuji, Osaka (JP); Masanari Fujita, Osaka (JP); Naoki Nakatake, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/938,648

(22) Filed: Jul. 10, 2013

(65) Prior Publication Data

US 2014/0029962 A1 Jan. 30, 2014

(30) Foreign Application Priority Data

Jul. 25, 2012 (JP) ..... 2012-164927

(51) Int. Cl.
*G03G 15/08* (2006.01)
*G03G 15/00* (2006.01)

(52) U.S. Cl.
CPC ..... *G03G 15/0831* (2013.01); *G03G 15/0824* (2013.01); *G03G 2221/183* (2013.01); *G03G 2215/0888* (2013.01); *G03G 15/553* (2013.01); *G03G 15/08* (2013.01); *G03G 15/0862* (2013.01); *G03G 15/0893* (2013.01); *G03G 15/0856* (2013.01)

(58) Field of Classification Search
CPC ..... G03G 15/08
USPC ..... 399/27
See application file for complete search history.

(56) References Cited

U.S. PATENT DOCUMENTS

| | | | | |
|---|---|---|---|---|
| 7,835,672 | B2 * | 11/2010 | Sakamoto et al. | 399/254 |
| 7,881,638 | B2 * | 2/2011 | Noguchi et al. | 399/254 |
| 2007/0104523 | A1 * | 5/2007 | Yoshida et al. | 399/358 |
| 2008/0089727 | A1 * | 4/2008 | Shimizu et al. | 399/360 |
| 2008/0095559 | A1 * | 4/2008 | Shimizu et al. | 399/358 |
| 2008/0145108 | A1 * | 6/2008 | Yoshida et al. | 399/256 |
| 2008/0145109 | A1 * | 6/2008 | Murayama et al. | 399/260 |

(Continued)

FOREIGN PATENT DOCUMENTS

| | | |
|---|---|---|
| JP | 5-173376 | 7/1993 |
| JP | 9-034208 | 2/1997 |

(Continued)

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

An image forming apparatus includes a powder container containing powder used for image forming and including an inlet through which the powder is supplied, a powder supply unit including an outlet that is removably connected to the inlet and supplying the powder to the powder container with the outlet connected to the inlet of the powder container, a powder amount detector detecting whether a present powder level in the powder container is equal to or greater than a threshold, and a controller controlling an amount of powder supply from the powder supply unit and controlling the present powder level in the powder container after replenishment to remain in a range from the threshold and a position corresponding to an upper edge of the inlet. A powder transport unit includes a transport decelerating part to decelerate the speed of powder transport and a detection area in the image forming apparatus.

12 Claims, 9 Drawing Sheets

(56) References Cited

U.S. PATENT DOCUMENTS

| | | | | |
|---|---|---|---|---|
| 2008/0170898 | A1* | 7/2008 | Shimizu et al. | 399/350 |
| 2009/0162101 | A1 | 6/2009 | Yoshida et al. | |
| 2009/0169265 | A1 | 7/2009 | Yoshida et al. | |
| 2012/0033982 | A1 | 2/2012 | Kubota et al. | |
| 2012/0189326 | A1 | 7/2012 | Yoshida et al. | |
| 2012/0189327 | A1 | 7/2012 | Kubota et al. | |
| 2012/0189350 | A1 | 7/2012 | Kubota et al. | |
| 2012/0230708 | A1 | 9/2012 | Fujita et al. | |

FOREIGN PATENT DOCUMENTS

| | | |
|---|---|---|
| JP | 2006-243446 | 9/2006 |
| JP | 2006-284747 | 10/2006 |

* cited by examiner

IMAGE FORMING APPARATUS AND POWDER TRANSPORT UNIT

CROSS-REFERENCE TO RELATED APPLICATIONS

This patent application is based on and claims priority pursuant to 35 U.S.C. §119 to Japanese Patent Application No. 2012-164927, filed on Jul. 25, 2012 in the Japan Patent Office, the entire disclosure of which is hereby incorporated by reference herein.

BACKGROUND

1. Technical Field

Embodiments of the present invention relate to an image forming apparatus including a powder container accommodating powder for image forming, and a powder transport unit to transport the powder in the powder container.

2. Related Art

Electrophotographic image forming apparatuses typically include development devices that develop an electrostatic latent image with powder toner into a visible image. The toner is refilled in response to an amount of toner consumption in each development device, typically by replacing each toner cartridge, as disclosed in Japanese Patent Publication JP-4673643-B (JP-2006-243446-A). When installing the toner cartridge in an image forming apparatus, an outlet of the toner cartridge is connected to an inlet of the development device, so that new toner is supplied from the toner cartridge to the development device.

Some development devices include an optical sensor to detect the amount of toner in the development device, as disclosed in Japanese Patent Application Publication JP-2006-284747-A. Based on the detection results obtained by the optical sensor, the toner is supplied form the toner cartridge to the development device when requested.

FIG. 1 illustrates a known development device in a state in which an amount of toner supplied to a toner cartridge has reached above an upper limit of an inlet thereof.

In a development device 200 without such an optical sensor or any other detector for detecting the maximum level of toner therein, toner T can reach a present toner level A0 beyond a position B0 that is the maximum toner level to be supplied through an inlet 200*a* of the development device 200, as illustrated in FIG. 1.

When disconnecting the toner cartridge from the development device 200 with the toner therein reaching above the position B0, it is likely that the toner falls out of the development device 200 through the inlet 200*a* and the fallen toner scatters to contaminate the interior of the image forming apparatus.

SUMMARY

The present invention provides an image forming apparatus including a powder container to contain powder used for image forming and include an inlet through which the powder is supplied, a powder supply unit including an outlet that is removably connected to the inlet and supplying the powder to the powder container with the outlet connected to the inlet of the powder container, a powder amount detector to detect whether a present powder level in the powder container is equal to or greater than a threshold, and a controller to control an amount of powder supply from the powder supply unit and to control the present powder level in the powder container after replenishment to maintain in a range from the threshold to a position corresponding to an upper edge of the inlet.

Further, the present invention provides a powder transporting member that is included the above-described image forming apparatus including a transport decelerating part provided upstream from a detection area in the powder transport direction to decelerate the speed of powder transport. The detection area is provided in a powder amount detector of an image forming apparatus to detect whether a present powder level supplied in a powder container provided in the image forming apparatus is equal to or greater than a threshold.

Further, the present invention provides an image forming apparatus including a powder container to contain powder used for image forming and include an inlet through which the powder is supplied, a powder supply unit including an outlet that is removably connected to the inlet and supplying the powder to the powder container with the outlet connected to the inlet of the powder container, a powder amount detector having a detection area to detect whether a present powder level in the powder container is equal to or greater than a threshold, and a controller to control an amount of powder supply from the powder supply unit and to control the present powder level in the powder container after replenishment to maintain in a range from the threshold to a position corresponding to an upper edge of the inlet, a detection area to detect whether the present powder level supplied in the powder container is less than the threshold, and a powder transport unit comprising a transport decelerating part provided upstream from the detection area in the powder transport direction to decelerate the speed of powder transport.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
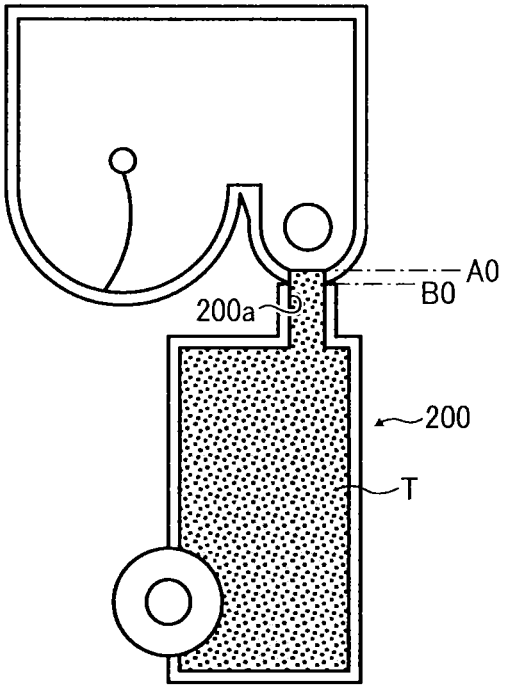
FIG. 1 RELATED ART
FIG. 1 is a diagram illustrating a known development device in a state in which an amount of toner supplied to a toner cartridge has reached above an upper limit of an inlet thereof.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Figure 2:
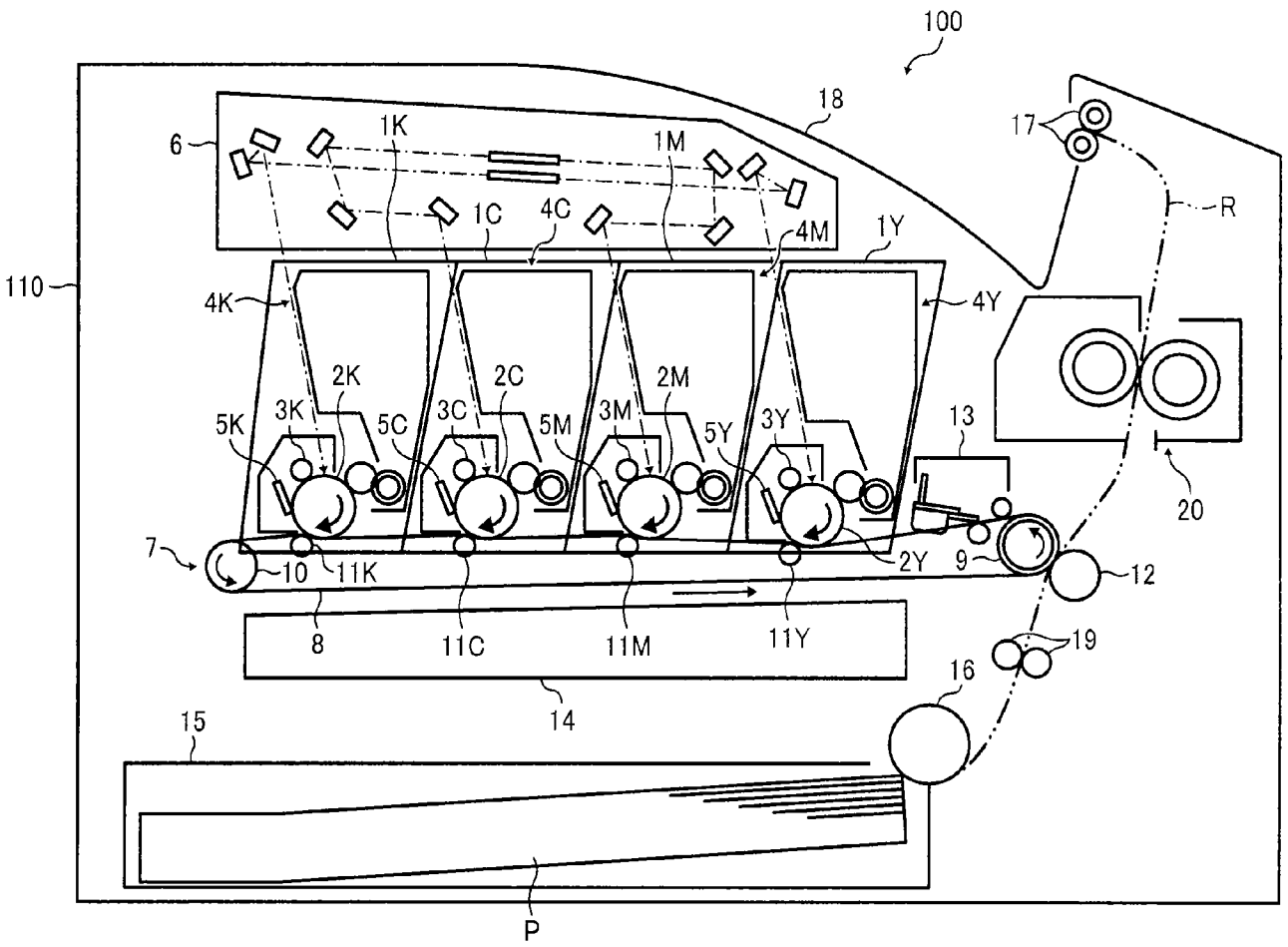
FIG. 2 is a cross-sectional view illustrating an image forming apparatus according to an embodiment of the present invention.

Referring to FIG. 2, a description is given of an overall configuration and functions of an image forming apparatus 100 according to an embodiment of the present invention.

FIG. 2 is a cross-sectional view illustrating the image forming apparatus 100, which is a color laser printer in the present embodiment.

As illustrated in FIG. 2, the image forming apparatus 100 may be a copier, a facsimile machine, a printer, a multifunction printer having at least one of copying, printing, scanning, plotter, and facsimile functions, or the like. The image forming apparatus 100 may form an image by an electrophotographic method, an inkjet method, and/or the like. According to this embodiment, the image forming apparatus 100 functions as a color laser printer for forming an image on a recording medium by the electrophotographic method.

As illustrated in FIG. 2, the image forming apparatus 100 includes four process units 1Y, 1M, 1C, and 1K, an exposure device 6, a transfer device 7, a waste toner container 14, a sheet tray 15, and a fixing device 20 in a body 110 thereof.

The process units 1Y, 1M, 1C, and 1K function as image forming units to form an image having different colors of yellow (Y), magenta (M), cyan (C), and black (K) corresponding to color separation of an original color document. Each process unit 1 (i.e., the process units 1Y, 1M, 1C, and 1K) includes a drum-shaped photoconductor 2 (i.e., drum-shaped photoconductors 2Y, 2M, 2C, and 2K) functioning as an image carrier to carry an electrostatic latent image on a surface thereof, a charging roller 3 (i.e., charging rollers 3Y, 3M, 3C, and 3K) functioning as a charger to uniformly charge the surface of the photoconductor 2, a development device 4 (i.e., development devices 4Y, 4M, 4C, and 4K) to develop or visualize the electrostatic latent image on the photoconductor 2, and a cleaning blade 5 (i.e., cleaning blades 5Y, 5M, 5C, and 5K) functioning as a cleaning member to clean the surface of the photoconductor 2.

The exposure device 6 is disposed at an upper portion of the body 110 of the image forming apparatus 100, above the process units 1Y, 1M, 1C, and 1K. The exposure device 6 functions as an electrostatic latent image forming device to form an electrostatic latent image on each surface of the photoconductors 2Y, 2M, 2C, and 2K. The exposure device 6 includes a power source, a polygon mirror, at least one f-theta lens, reflection mirrors and the like, and emit a laser light beam to a surface of each photoconductor 2 based on image data.

The transfer device 7 is disposed below the process units 1Y, 1M, 1C, and 1K. The transfer device 7 includes an intermediate transfer belt 8 including an endless belt functioning as an intermediate transfer member. The intermediate transfer belt 8 is stretched around support members, which, in the present embodiment, are a driving roller 9 and a driven roller 10. As the driving roller 9 rotates counterclockwise in FIG. 2, the intermediate transfer belt 8 moves or rotates in a direction indicated by arrow in FIG. 2.

Four primary transfer rollers 11Y, 11M, 11C, and 11K, each functioning as a primary transfer member, are disposed facing the photoconductors 2Y, 2M, 2C, and 2K, respectively. The primary transfer rollers 11Y, 11M, 11C, and 11K press the inner circumferential surface of the intermediate transfer belt 8 against the photoconductors 2Y, 2M, 2C, and 2K, so that respective primary transfer nips are formed between the photoconductors 2 and the intermediate transfer belt 8. The primary transfer rollers 11Y, 11M, 11C, and 11K are connected to a non-illustrated power supply, so that a given direct current voltage (DC voltage) and/or a given alternating current voltage (AC voltage) are applied to the primary transfer rollers 11Y, 11M, 11C, and 11K.

A secondary transfer roller 12 is disposed facing the driving roller 9 with the intermediate transfer belt 8 interposed therebetween. The secondary transfer roller 12 functions as a secondary transfer member to press the outer circumferential surface of the intermediate transfer belt 8 against the driving roller 9, so that a secondary transfer nip is formed between the secondary transfer roller 12 and the intermediate transfer belt 8. Similar to the primary transfer rollers 11Y, 11M, 11C, and 11K, the secondary transfer roller 12 is connected to a non-illustrated power supply, so that a given direct current voltage (DC voltage) and/or a given alternating current voltage (AC voltage) are applied to the secondary transfer roller 12.

A belt cleaning device 13 is disposed at the right of the intermediate transfer belt 8 in FIG. 2. The belt cleaning device 13 is located on the outer circumferential surface of the intermediate transfer belt 8 to clean the surface of the intermediate transfer belt 8. The belt cleaning device 13 includes a non-illustrated waste toner transfer hose extending therefrom and being connected to an entrance of the waste toner container 14 that is disposed below the transfer device 7.

The sheet tray 15 and a feed roller 16 are disposed at a lower portion of the body 110 of the image forming apparatus 100, below the transfer device 7. The sheet tray 15 accommodates a stack of recording media including a paper P. The feed roller 16 feeds the paper P from the sheet tray 15. The recording media includes sheets of regular copy paper, thick paper, thin paper, and coated paper including art paper, postcards, envelopes, tracing paper, OHP sheet, and the like.

The image forming apparatus 100 further includes a sheet pathway R in the body 110 thereof. Through the sheet pathway R, the paper P is fed from the sheet tray 15, is conveyed through the secondary transfer nip, and is discharged to the outside of the image forming apparatus 100. In the sheet pathway R, a pair of registration rollers 19 functioning as a pair of timing rollers is disposed between the feed roller 16 and the secondary transfer roller 12.

The fixing device 20 is disposed in the sheet pathway R, downstream from the secondary transfer roller 12 in a sheet conveying direction. The fixing device 20 fixes an unfixed toner image held on the paper P to the paper P by application of heat and pressure.

Further, the image forming apparatus 100 includes a pair of discharging rollers 17 and a sheet discharging tray 18. The pair of discharging rollers 17 is disposed at the end of the sheet pathway R to discharge the paper P to the outside of the image forming apparatus 100. The sheet discharging tray 18 is formed on top of the body 110 to store the paper P discharged by the pair of discharging rollers 17.

A description is given of image forming operations performed by the image forming apparatus 100.

At a start of the image forming operations, the photoconductor 2 (i.e., the photoconductors 2Y, 2M, 2C, and 2K) of the process unit 1 (i.e., the process units 1Y, 1M, 1C, and 1K) rotates clockwise and the charging roller 3 (i.e., the charging rollers 3Y, 3M, 3C, and 3K) uniformly charges the surface of the photoconductor 2 to a given toner charge polarity. Based on image data of an original document that is scanned by a non-illustrated image reader, the exposure device 6 emits a laser light beam to the charged surface of the photoconductor 2, so that an electrostatic latent image is formed thereon. The image data to be exposed to the surface of the photoconductor 2 is single color image data according to color separation into yellow, magenta, cyan, and black. Then, toner functioning as powder for image forming is supplied to the thus-formed electrostatic latent image on the surface of the photoconductor 2. As a result, the electrostatic latent image is developed to a visible toner image.

On the other hand, at the start of the image forming operations, the driving roller 9 that stretches the intermediate transfer belt 8 taut rotates to rotate the intermediate transfer belt 8 endlessly in a direction indicated by arrow in FIG. 2. By applying a voltage with constant controlled voltage or constant current control at a polarity opposite to the toner charge polarity to the primary transfer roller 11 (i.e., the primary transfer rollers 11Y, 11M, 11C, and 11K), an electric field is generated in the primary transfer nip formed between the primary transfer rollers 11 and the photoconductor 2.

Thereafter, as the photoconductor 2 rotates, the toner image formed on the photoconductor 2 reaches the primary transfer nip. At this time, the toner images formed on the photoconductors 2Y, 2C, 2M, and 2K are transferred sequentially onto the surface of the intermediate transfer belt in the electric field generated in the primary transfer nip. As a result, a full-color toner image is formed and held on the surface of the intermediate transfer belt 8.

Residual toner remaining on the surface of the intermediate transfer belt 8 even after the primary transfer is removed by the cleaning blade 5.

The feed roller 16 disposed at the lower portion of the body 110 of the image forming apparatus 100 starts rotating to feed the paper P from the sheet tray 15 to the sheet pathway R. In the sheet pathway R, the paper P is conveyed under time control by the pair of registration rollers 19 to the secondary transfer nip formed between the secondary transfer roller 12 and the driving roller 9 via the intermediate transfer belt 8. At this time, the secondary transfer roller 12 is applied with a voltage having a polarity opposite to the toner charge polarity to the toner image formed on the intermediate transfer belt 8. As a result, an electric field is generated in the secondary transfer nip.

Then, as the intermediate transfer belt 8 rotates, the toner image held on the intermediate transfer belt 8 reaches the secondary transfer nip. At this time, the toner image on the intermediate transfer belt 8 is transferred onto the paper P in an electric field generated at the secondary transfer nip.

Thereafter, residual toner remaining on the surface of the intermediate transfer belt 8 is removed by the belt cleaning device 13, and is then conveyed to be collected to the waste toner container 14.

Then, the paper P having the toner image thereon is conveyed to the fixing device 20 in which the toner image is fixed to the paper P. Thereafter, the paper P is discharged by the pair of discharging rollers 17 to the outside of the body 110 of the image forming apparatus 100 and is stacked on the sheet discharging tray 18.

The above-described operations are for forming a full-color image on a sheet of recording medium. Alternatively, the image forming apparatus 100 can form a single-color image with any one of the process units 1Y, 1M, 1C, and 1K or a two- or three-color image with two or three of the process units 1Y, 1M, 1C, and 1K.

Figure 3:
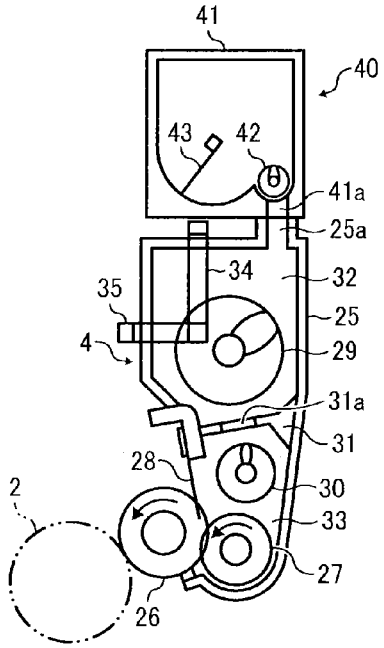
FIG. 3 is a cross-sectional view illustrating a development device included in the image forming apparatus, along a sheet conveying direction.

FIG. 3 is a cross-sectional view illustrating the development device 4 included in the image forming apparatus 100.

As illustrated in FIG. 3, the development device 4 includes a development housing 25, a development roller 26, a toner supply roller 27, a development blade 28, a first toner transport screw unit 29, and a second toner transport screw unit 30. The development roller 26 functions as a developer carrier to carry toner thereon. The toner supply roller 27 functions as a developer supplier to supply the toner to the development roller 26. The development blade 28 functions as a regulating member to regulate an amount of toner held on the development roller 26. The first toner transport screw unit 29 and the second toner transport screw unit 30 function as powder transport units to transport the toner.

As illustrated in FIG. 3, a partition 31 divides the interior of the development housing 25 into an upper section and a lower section. The upper section corresponds to a developer container section 32 functioning as a powder container and the lower section corresponds to a development section 33.

The developer container section 32 includes the first toner transport screw unit 29, and contains the toner used for image forming. The developer container section 32 further includes an inlet 25*a* through which the toner is supplied.

The development section 33 includes the development roller 26, the toner supply roller 27, the development blade 28, and the second toner transport screw unit 30.

Figure 4:
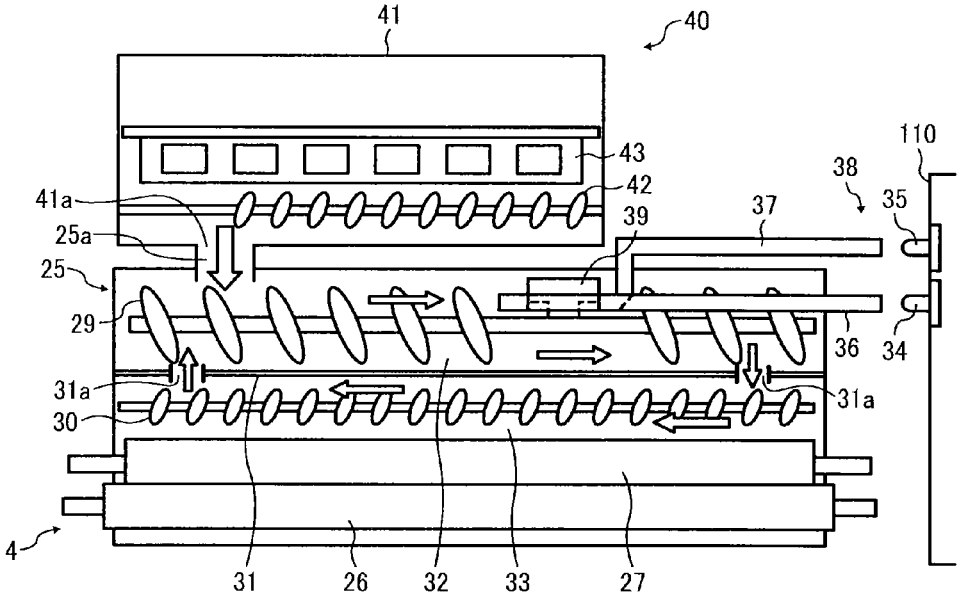
FIG. 4 is a cross-sectional view illustrating the development device of FIG. 2, along a direction perpendicular to the sheet conveying direction.

As illustrated in FIG. 4, openings 31*a* are formed at both ends of the partition 31, through which the developer container section 32 and the development section 33 communicate each other. In addition, the first toner transport screw unit 29 and the second toner transport screw unit 30 are configured to transport toner in opposite directions as indicated by arrows in FIG. 4. As a result, the toner transported by the first toner transport screw unit 29 and the second toner transport screw unit 30 are conveyed from one section to the other via the openings 31*a*, so that the toner circulates between the developer container section 32 and the development section 33.

The development roller 26 of the present embodiment includes a metallic core and a conductive rubber layer around the outer circumference of the metallic core. The development roller 26 is designed to have an outer diameter of the metallic core of ϕ6, an outer circumference of the conductive rubber of ϕ12, a degree of rubber hardness of Hs 75. The conductive rubber layer is adjusted to have a volume resistivity of from about $10^5$ Ω·cm (ohm centimeters) to about $10^7$ Ω·cm. As an example of conductive rubber, conductive urethane rubber and silicone rubber can be used. The development roller 26 rotates counterclockwise in FIG. 3 to convey the toner held thereon to a portion where the development blade 28 and the photoconductor 2 face each other.

Typically a sponge roller is used as the toner supply roller 27. Such a sponge roller preferably includes a metallic core and a semiconducting carbon-mixed polyurethane foam attached around an outer circumference of the metallic core. The toner supply roller 27 according to the present embodiment is designed to have an outer diameter of the metallic core of ϕ6 and an outer diameter of sponge portion of ϕ12. The toner supply roller 27 remains in contact with the development roller 26, forming a nip therebetween. The length of the nip is typically set in a range of from approximately 1 mm to approximately 3 mm. The length of the nip in the present embodiment is set to 2 mm.

The toner supply roller 27 rotates counterclockwise in FIG. 3 with respect to the development roller 26, and therefore the toner in the development housing 25 can be effectively provided to a top surface of the development roller 26. In the present embodiment, the speed ratio of the development roller 26 and the toner supply roller 27 is set to 1 so as to obtain a good function of toner supply is provided.

The development blade 28 includes a metallic plate such as SUS having a thickness of approximately 0.1 mm, for example. A free end of the development blade 28 remains in contact with the surface of the development roller 26. When the toner supplied to the surface of the development roller 26 by the toner supply roller 27 passes between the development roller 26 and the development blade 28, the thickness of toner is regulated and the toner is charged by friction. Control of the amount of toner on the development roller 26 is a critical parameter to stabilize property of image development and obtain good image quality. Therefore, the settings of typical products are strictly controlled. Namely, the contact pressure of the development blade 28 against the development roller 26 is set to a range of from 20 N/m to 60 N/m and the position of the nip between the development roller 26 and the development blade 28 is 0.5±0.5 mm from the free end of the development blade 28. In addition, these parameters are optionally determined according to the properties of components to be used in an image forming apparatus such as toner, a development roller, and a toner supply roller. In the present embodiment, the development blade 28 includes a SUS member having a thickness of 0.1 mm, the contact pressure of the development blade 28 against the development roller 26 is set to 45 N/m, the nip position is 0.2 mm from the free end of the development blade 28, and a (free) length of the development blade 28 from the fixed end to the free end is 14 mm. With these settings, a thin layer of toner can be formed on the development roller 26 reliably.

As illustrated in FIG. 3, a toner supply unit 40 that functions as a powder supply unit is disposed above the development device 4. The toner supply unit 40 supplies toner to the development device 4 and includes a toner cartridge 41, a toner transport screw unit 42, and an agitator 43. The toner cartridge 41 functions as a pre-supply powder container to contain toner to be supplied. The toner transport screw unit 42 functions as a powder transport unit provided in the toner cartridge 41. The agitator 43 functions as a powder agitator.

The toner cartridge 41 is attached to or detached from the top of the development device 4. A lower portion of the toner cartridge 41 includes an outlet 41*a* from which the toner contained in the toner cartridge 41 is supplied. The outlet 41*a* is connected to or disconnected from the inlet 25*a* formed on the top of the development housing 25 of the development device 4 according to attachment or detachment of the toner cartridge 41, respectively. The toner supply unit 40 supplies the toner to the developer container section 32 with the outlet 41*a* connected to the inlet of the developer container section 32.

The toner transport screw unit 42 and the agitator 43 are driven by a non-illustrated drive unit. As the toner transport screw unit 42 rotates, the toner in the toner cartridge 41 is transported to the outlet 41*a* (as illustrated in FIG. 4). Rotation of the agitator 43 agitates the toner in the toner cartridge 41 and causes the toner to move toward the toner transport screw unit 42.

Figure 5:
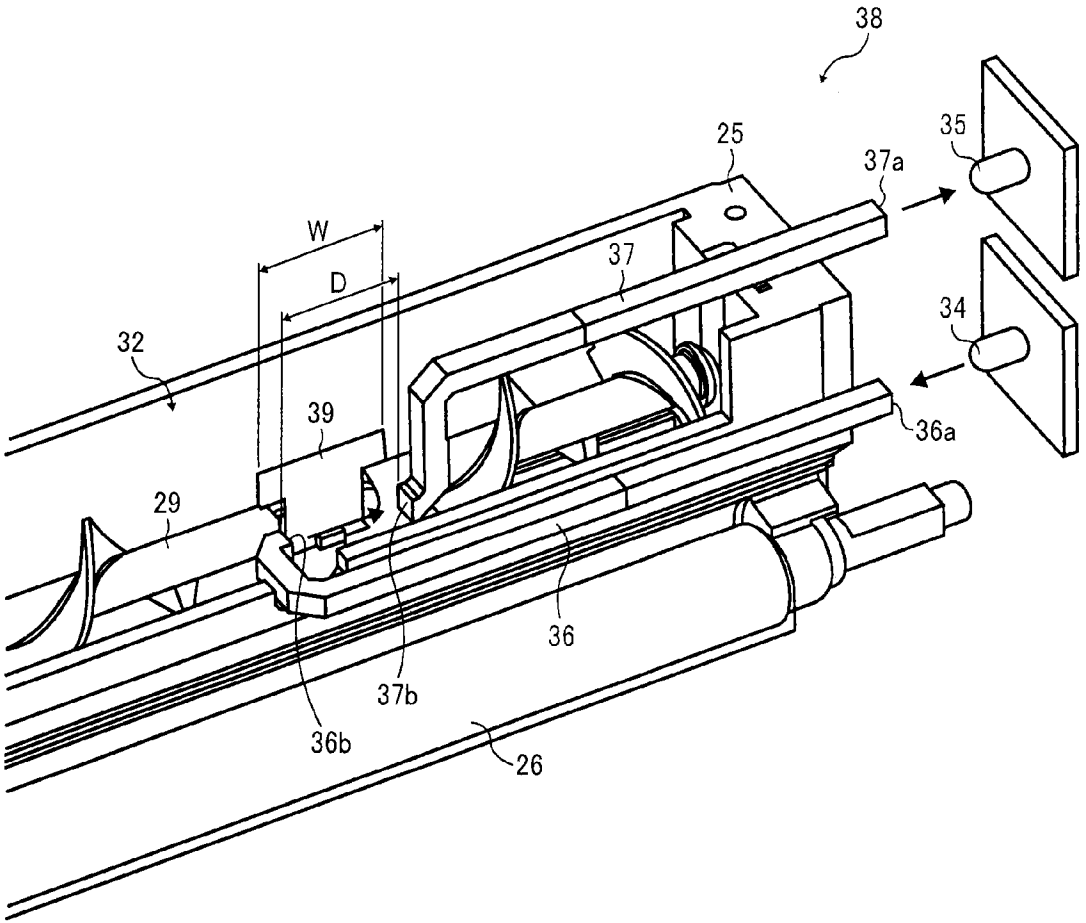
FIG. 5 is a perspective view illustrating a toner amount detector included in the development device.

FIG. 5 is a perspective view illustrating a toner amount detector 38 included in the development device 4. The toner amount detector 38 in the present embodiment is an optical sensor.

As illustrated in FIG. 5, the toner amount detector 38 includes a light emitting element 34, a light receiving element 35, a first light guiding member 36, and a second light guiding member 37. The light emitting element 34 emits laser light and the light receiving element 35 receives the laser light. Both the first light guiding member 36 and the second light guiding member 37 guide the light from the light emitting element 34 to the light receiving element 35. The toner amount detector 38 detects presence of the toner by determining whether the toner blocks a light pathway from the light emitting element 34 to the light receiving element 35.

The first light guiding member 36 and the second light guiding member 37 include, for example, a material having good optical transparency. If any resin material is used, a highly clear acryl material or a PC (polycarbonate) material is preferably employed. Alternatively, the first light guiding member 36 and the second light guiding member 37 can include an optical glass having better optical property than the resin material or an optical fiber that can provide more flexibility in the design of the light pathway.

The light emitting element 34 and the light receiving element 35 are provided in the body 110 of the image forming apparatus 100 as illustrated in FIG. 4 and the first light guiding member 36 and the second light guiding member 37 are provided in the development housing 25 of the development device 4. The first light guiding member 36 and the second light guiding member 37 include first ends 36*a* and 37*a* at one end and second ends 36*b* and 37*b* at an opposite end, respectively. The first ends 36*a* and 37 are exposed and projected outward from the development housing 25 and the second ends 36*b* and 37*b* are disposed inside the development housing 25. The first end 36*a* exposed outward from the development housing 25 is disposed facing the light emitting element 34. The first end 37*a* exposed outward from the development housing 25 is disposed facing the light receiving element 35. The second ends 36*b* and 37*b* arranged in the development housing 25 are disposed facing each other with a given gap therebetween.

The laser light emitted by the light emitting element 34 enters from the first end 36*a* extending from the first light guiding member 36, exits from the second end 36*b* opposite to the first end 36*a*, and enters to the second end 37*b* of the second light guiding member 37. Then, the laser light exits from the second end 37*b* of the second light guiding member 37, so as to reach the light receiving element 35.

If the development housing 25 has sufficient toner therein, the toner existing between the second ends 36*b* and 37*b* blocks the light pathway, the light does not reach the light receiving element 35. By contrast, when the toner is consumed due to printing, the upper limit of the toner becomes below the respective positions of the first light guiding member 36 or the second light guiding member 37. Consequently, no toner exists between the second ends 36*b* and 37*b*, thereby causing the laser light to reach the light receiving element 35. Detection of an output at the light receiving element 35 at this point indicates that a present toner level that corresponds to a height of toner in the development device 4 is below or less than a threshold, which is a toner detectable level between the first and second light guiding members 36 and 37.

In the present embodiment, a cleaning member 39 is disposed on the first toner transport screw unit 29 as illustrated in FIG. 5. The cleaning member 39 cleans the second ends 36*b* and 37*b* disposed facing each other. The cleaning member 39 includes a flexible member such as a PET sheet. A width W of the cleaning member 39 along its axial direction is slightly greater a distance D between the second ends 36*b* and 37*b*. Therefore, as the first toner transport screw unit 29 rotates, the cleaning member 39 contacts respective end surfaces of the second ends 36*b* and 37*b* to remove residual toner remaining on the end surfaces thereof. According to this configuration, a good status of light passage from the first light guiding member 36 to the second light guiding member 37 can be maintained. As a result, it is likely to avoid misdetection by blocking the light passage due to adhesion of foreign material on the end surfaces of the first and second light guiding members 36 and 37.

As described above, the toner cartridge 41 can be attached to and detached from the development device 4.

In a conventional image forming apparatus, if a present toner level in a development device is above the upper end portion of an inlet, when a toner cartridge is detached from the development device, it is likely that the toner contained therein comes out from the development device through the inlet and the toner scatters enough to contaminate the interior of the image forming apparatus.

To avoid the above-described problem, an amount of toner supply from the toner cartridge 41 to the development device 4 is controlled as follows.

Figure 6:
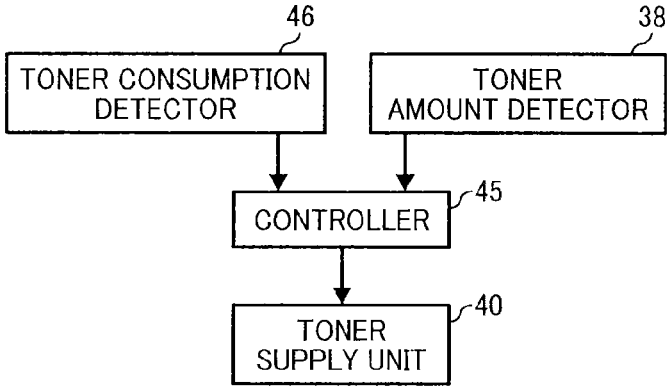
FIG. 6 is a block diagram illustrating a controller controlling an amount of toner supply.

FIG. 6 is a block diagram illustrating a controller 45 controlling an amount of toner supply.

As illustrated in FIG. 6, the controller 45 including a central processing unit (CPU) controls an entire system of the image forming apparatus 100 and is operatively connected to the toner amount detector 38, the toner supply unit 40, and a toner consumption detector 46.

The controller 45 controls and determines the amount of toner supply from the toner supply unit 40 to the development device 4 by controlling driving of the toner supply unit 40. When the controller 45 determines that the development device 4 to be replenished with toner, the toner transport screw unit 42 and the agitator 43 in the toner cartridge 41 are rotated to supply toner to the development device 4.

The controller 45 determines whether the toner is supplied or not based on detection results obtained by the toner amount detector 38 and the toner consumption detector 46.

The toner consumption detector 46 calculates and detects an amount of toner consumption in the development device 4 according to the number of image dots based on data of the number of image dots during the image forming operation.

Figure 7:
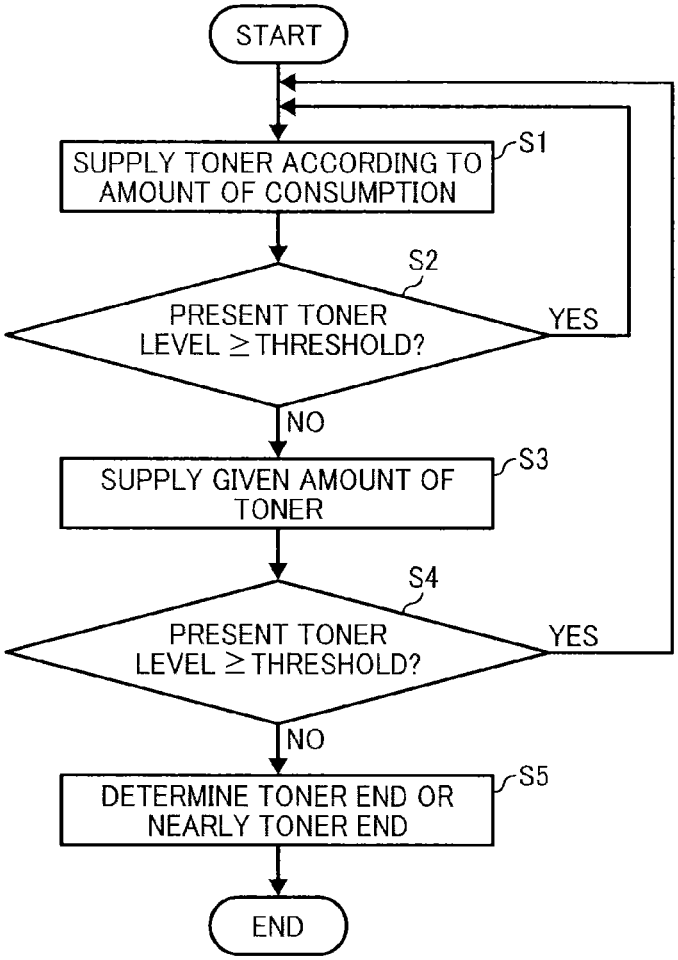
FIG. 7 is a flowchart showing a control of the amount of toner supply.
Figure 8:
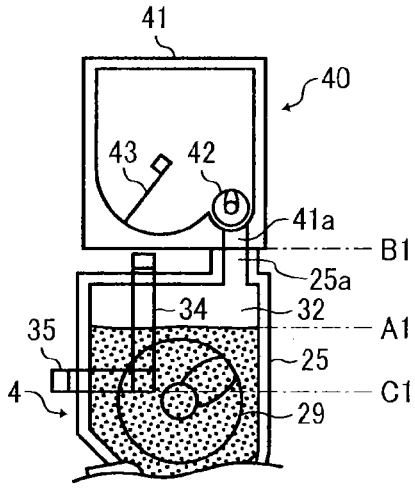
FIG. 8 is a diagram illustrating heights or levels of amount of toner in the development device.

Now, a detailed description is given of the toner supply from the toner supply unit 40 to the development device 4, with reference to FIGS. 7 and 8.

FIG. 7 shows a flowchart showing a control of the amount of toner supply. FIG. 8 shows heights of amount of toner in the development device 4. Regarding reference symbol in FIG. 8, "present toner level A1" represents a level indicating how much toner is presently supplied in the development device 4, "position B1" represents a position of an upper end of the inlet 25*a*, and "threshold C1" represents a threshold level of toner supply for the development device 4.

As illustrated in the flowchart of FIG. 7, the controller 45 causes the toner supply unit 40 to supply toner according to the amount of toner consumption based on data regarding the number of image dots detected by the toner consumption detector 46 in step S1. The amount of toner supply is estimated smaller than the calculated amount of toner consumption.

The toner may not be supplied by each image forming operation. For example, the toner can be supplied after a given number of image forming operation has been performed.

After the toner supply to the development device 4 in step S1, the controller 45 causes the toner amount detector 38 to determine whether the present toner level A1 in the development device 4 (i.e., the developer container section 32) is equal to or greater than the threshold C1 in step S2.

When the toner amount detector 38 determines that the present toner level A1 is equal to or greater than the threshold C1, the procedure returns to start step S1 to continue the flow of toner supply according to the amount of toner consumption.

As described above, in toner supply according to the amount of toner consumption, the controller 45 controls the toner supply unit 40 to supply an amount of toner less than the calculated amount of toner consumption. Therefore, the amount of toner in the development device 4 gradually decreases. Then, the present toner level A1 in the development device 4 has reached under the threshold C1, the given amount of toner is supplied to the development device 4 in step S3. The action in step S3 is to increase the amount of toner in the development device 4.

An amount of toner supply upon the present toner level A1 below the threshold C is previously determined. Specifically, the controller 45 adjusts the present toner level A1 in the developer container section 32 of the development device 4 after replenishment to maintain in a range from the threshold C1 to the position B1 corresponding to an upper edge of the inlet 25*a*, as illustrated in FIG. 8.

Thereafter, the controller 45 causes the toner amount detector 38 to detect whether the present toner level A1 in the development device 4 (i.e., the developer container section 32) is equal to or greater than the threshold C1 in step S4.

When the toner amount detector 38 determines that the present toner level A1 is equal to or greater than the threshold C1, the procedure returns to start step S1 to continue the flow of toner supply according to the amount of toner consumption.

When the toner amount detector 38 determines that the present toner level A1 is less than the threshold C1, the controller 45 determines that the toner in the toner cartridge 41 is empty (which is referred to as "toner end") or that the toner in the toner cartridge 41 is almost empty (which is referred to as "toner near end") in step S5 and causes the toner supply unit 40 to stop toner supply. Alternatively, the controller 45 can encourage users to replace a used toner cartridge to a new one with a display on a control panel, sound, light, and so on.

As described above, the controller 45 of the present embodiment performs two types of toner supply control. In a first control, the toner is supplied according to the amount of toner consumption. In a second control, the toner is supplied by a given amount. The amount of toner supply in the first control is smaller or less than the actual amount of toner consumption. Consequently, the present toner level A1 in the first control may not be above an upper end portion of the inlet 25*a*. Further, the amount of toner supply in the second control is previously adjusted so that the present toner level A1 after replenishment is maintained in the range from the threshold C1 to the position B1 of the inlet 25*a*, as illustrated in FIG. 8. Accordingly, the present toner level A1 in the second control may not be above the upper end portion of the inlet 25*a*.

As described above, in the image forming apparatus 100 according to the present embodiment, the amount of toner in the development device 4 can be adjusted so that the present toner level A1 does not exceed the upper end portion of the inlet 25*a*. As a result, when the toner cartridge 41 is detached from the development device 4 to release the inlet 25*a* open, falling and scattering of the toner from the inlet 25*a* can be prevented, thereby reducing contamination of the interior or exterior of the image forming apparatus 100 with the fallen toner. Further, users and operators can become free from caution or burden due to toner falling and scattering can be reduced, thereby facilitating handling of the toner cartridge 41.

Figure 9:
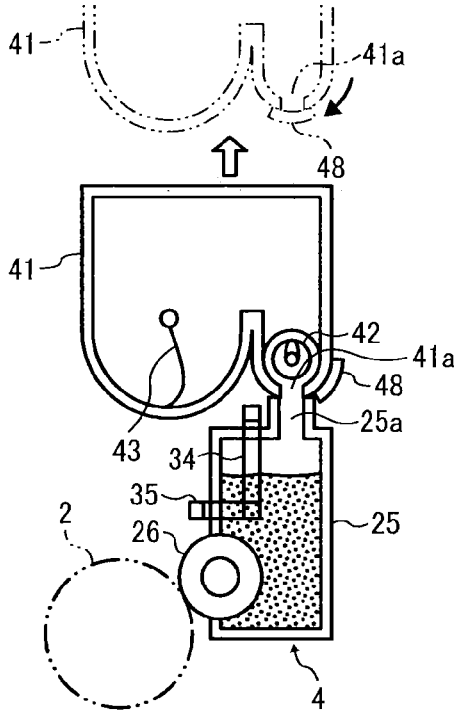
FIG. 9 is a diagram illustrating a toner cartridge with a shutter.

FIG. 9 is a diagram illustrating the toner cartridge 41 with a shutter 48 provided to open/close at the outlet 41*a*. As illustrated with two-dot chain lines in FIG. 9, when the toner cartridge 41 is detached from the development device 4, the shutter 48 moves to close the outlet 41*a*, thereby preventing toner falling from the outlet 41*a*.

Figure 10:
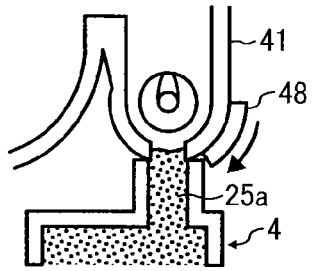
FIG. 10 is a diagram illustrating a state in which an amount of toner supplied to the toner cartridge of FIG. 8 has reached above an inlet of the development device.

However, as illustrated in FIG. 10, if the present toner level A1 in the development device 4 is above the upper end portion of the inlet 25*a*, the toner on the inlet 25*a* may be scattered due to the shutter 48 sliding to a close position. Therefore, the above-described configuration with the amount of toner supply effectively controlled can prevent such toner scattering caused by movement of the shutter 48 and maintain the present toner level A1 lower than the upper end portion of the inlet 25*a*.

It is to be noted that the above-described toner supply control is also applicable to a configuration in which a shutter is provided to the inlet 25*a* of the development device 4 or a configuration in which respective shutters are provided to the inlet 25*a* and the outlet 41*a*.

Figure 11:
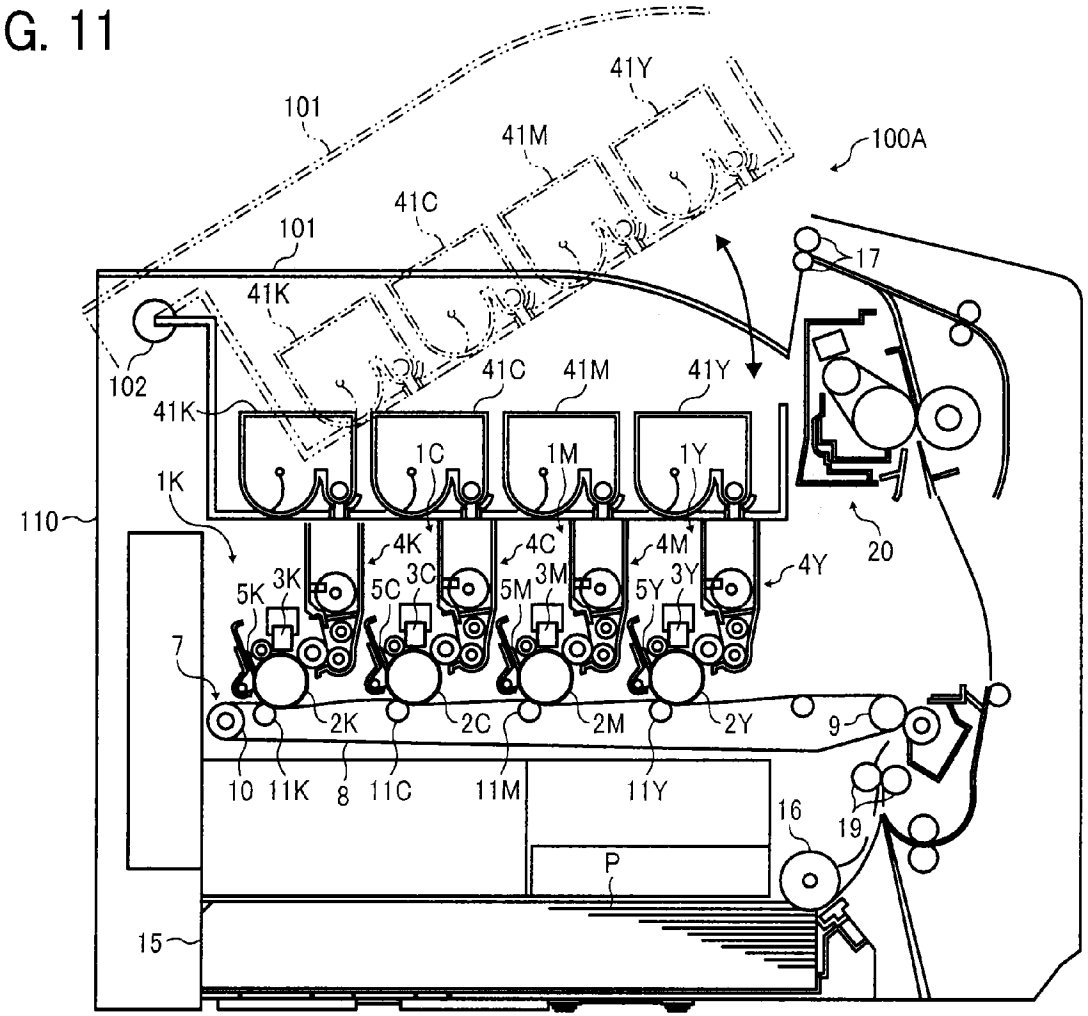
FIG. 11 is a cross-sectional view illustrating an image forming apparatus to which multiple toner cartridges are installed or removed by closing or opening a cover attached to the image forming apparatus.

FIG. 11 is a schematic cross-sectional view illustrating an image forming apparatus 100A according to another embodiment.

As illustrated in FIG. 11, the image forming apparatus 100A further includes a cover 101 attached to the body 110 and a support shaft 102 about which the cover 101 rotates for opening and closing the top of the body 110 of the image forming apparatus 100A. Multiple toner cartridges 41 (i.e., the toner cartridges 41Y, 41M, 41C, and 41K) are integrally provided in the cover 101 to be attached to or detached from the respective development devices 4 (i.e., the development devices 4Y, 4M, 4C, and 4K) according to the opening and closing of the cover 101.

With this configuration illustrated in FIG. 11, the respective outlets 41*a* of the multiple toner cartridges 41 are detached from the respective inlets 25*a* of the development devices 4 simultaneously. Therefore, it is difficult for user or operator to open or close the cover 101 while being careful not to fall the toner out of the inlets 25*a*. If the toner comes out and fall from the inlet 25*a*, a greater area may be contaminated with toner. Therefore, by applying the above-described control of the amount of toner supply to the image forming apparatus 100A, toner falling or scattering from the inlet 25*a* can be prevented and a greater effect can be achieved.

In the configuration of the image forming apparatus 100A illustrated in FIG. 11, the shutter 48 is provided to the outlet 41*a* of the toner cartridge 41. However, the above-described control of the amount of toner supply is also applicable to a configuration in which a shutter is provided to the inlet 25*a* of the development device 4, a configuration in which respective shutters are provided to the inlet 25*a* and the outlet 41*a*, or a configuration in which no shutter is provided.

A method of detaching and attaching the multiple toner cartridges 41 together is not limited to the above-described method by using the cover 101 as illustrated in FIG. 11. For example, an image forming apparatus 100B illustrated in FIG. 12 includes a tray-type holder 49. The tray-type holder 49 holds the multiple toner cartridges 41 (i.e., the toner cartridges 41Y, 41M, 41C, and 41K) to attach to or detach from the body 100 of the image forming apparatus 100 vertically, so that the multiple toner cartridges 41 can be detached from or attached to the image forming apparatus 100.

Figure 13:
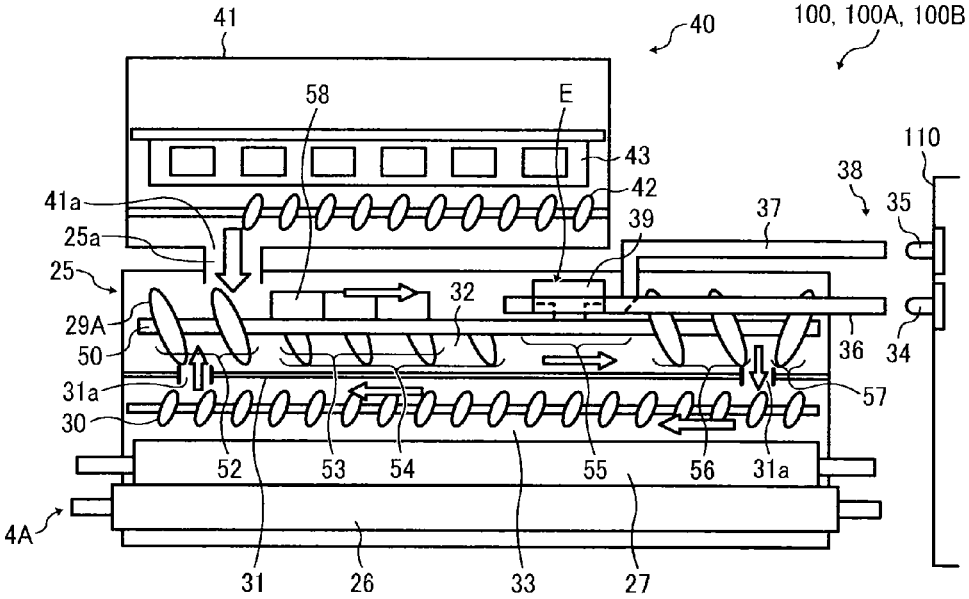
FIG. 13 is a cross-sectional view illustrating an image forming apparatus according to yet another embodiment.

FIG. 13 is a cross-sectional view illustrating a configuration of a development device 4A according to yet another embodiment.

As illustrated in FIG. 13, the development device 4A includes a first toner transport screw unit 29A provided in the developer container section 32. The other components and units are the same as those provided in the development device 4.

Figure 14:
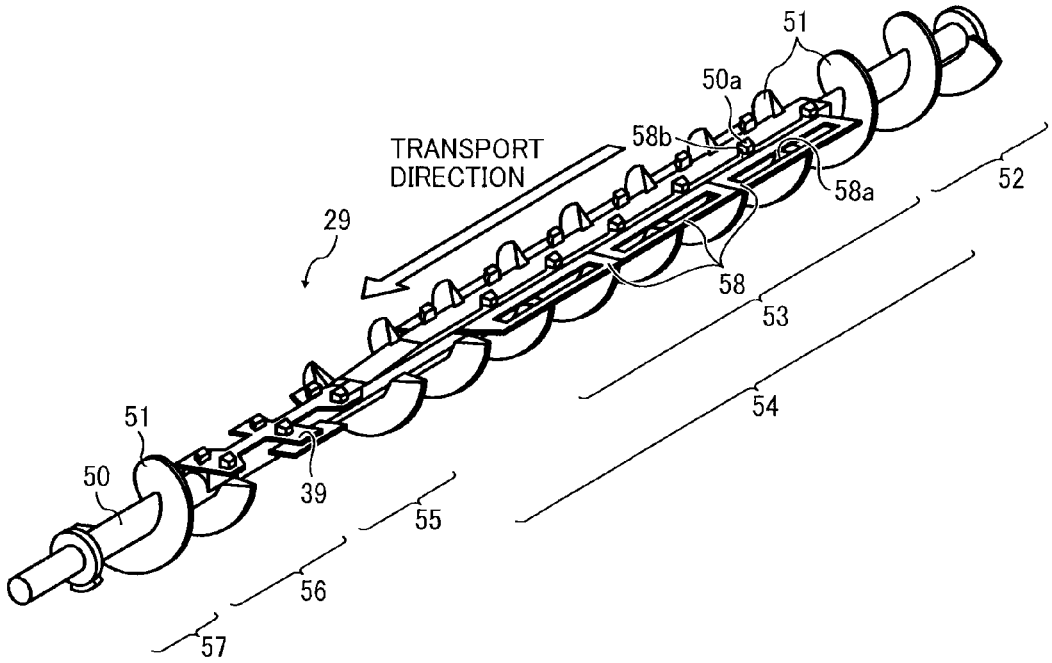
FIG. 14 is a perspective view illustrating a conveyance screw unit included in the development device illustrated in FIG. 13.

FIG. 14 is a perspective view illustrating the first toner transport screw unit 29A shown in FIG. 13.

As illustrated in FIG. 14, the first toner transport screw unit 29A includes a rotary shaft 50 and a helical transport blade 51 that is mounted on an outer circumferential surface of the rotary shaft 50. The first toner transport screw unit 29A has multiple configurations along the rotary shaft 50 in a powder transport direction. Namely, the multiple configurations are an upstream transport facilitating part 52, an agitating part 53, a transport decelerating part 54 partly including the agitating part 53, a detecting part 55, a downstream transport facilitating part 56, and a transport reversing part 57, as arranged in the order from an upstream side to a downstream side in the powder transport direction.

The upstream transport facilitating part 52 is located facing the inlet 25*a* as illustrated in FIG. 13. The upstream transport facilitating part 52 includes the transport blade 51 over the whole outer circumference of the rotary shaft 50.

Figure 12:
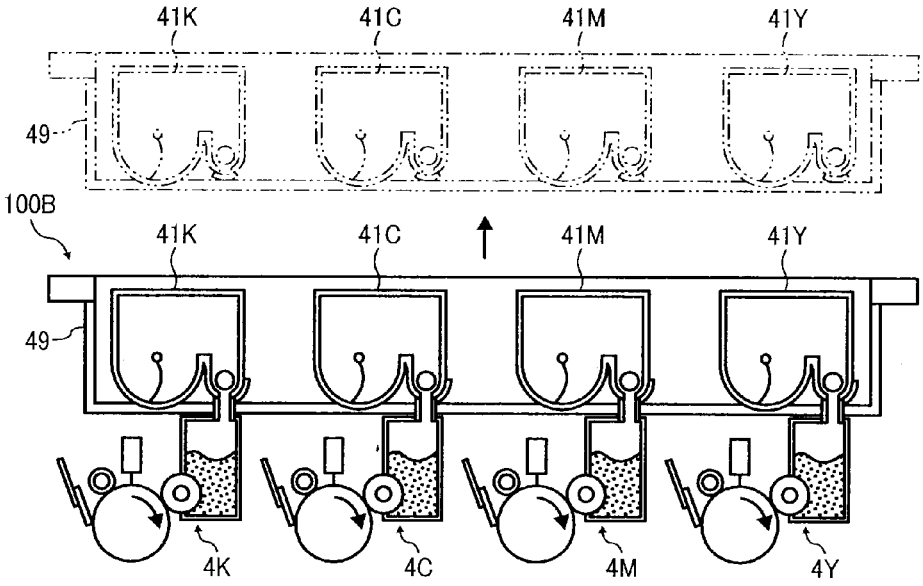
FIG. 12 is a cross-sectional view illustrating an image forming apparatus, according to another embodiment.

The transport decelerating part 54 decelerates or delays the speed of toner transport and is located downstream from the inlet 25*a* in the powder transport direction and upstream from a detection area E located in the toner amount detector 38 in the powder transport direction, as illustrated in FIG. 12. The detection area E is located between the end portion 36*b* of the first light guiding member 36 and the end portion 37*b* of the second light guiding member 37 facing each other, as illustrated in FIG. 5. The detection area E detects whether the present toner level A1 supplied in the developer container section 32 of the development device 4 is equal to or greater than the threshold C1. The transport decelerating part 54 includes the transport blade 51 over a part of the outer circumference of the rotary shaft 50. According to this configuration, the transport decelerating part 54 transports the toner at a speed slower than the upstream transport facilitating part 52.

The agitating part 53, which is a part of the transport decelerating part 54, includes the transport blade 51 over the part of the outer circumference of the rotary shaft 50 and planar agitator blades 58 formed of a flexible PET (PolyEthylene Terephthalate) sheet. Each of the agitator blades 58 according to the present embodiment includes a slot 58*a* to pass the toner therethrough so as to reduce a load on the agitator blades 58 received from toner when the agitator blades 58 start rotating.

The rotary shaft 50 further includes multiple claws 50*a* to attach the agitator blades 58 thereto, and the agitator blades 58 includes multiple coupling holes 58*b* to be engaged with the multiple claws 50*a*. According to the present embodiment, the agitator blade 58 is attached to rotary shaft 50 by inserting the claws 50*a* into the respective coupling holes 58*b* and engaging the claws 50*a* with the coupling holes 58*b*. The above-described configuration may not use any adhesive tape to attach the agitator blades 58 to the rotary shaft 50, thereby providing a simpler configuration and better assembly.

The whole transport decelerating part 54 extends longer than the agitating part 53 toward a downstream side of the rotary shaft 50 in the powder transport direction. In other words, the agitator 58 is not provided to the transport decelerating part 54 on the downstream side in the powder transfer direction, which is closer to the detection area E located in the toner amount detector 38.

The detecting part 55 is located facing the detection area E, as illustrated in FIG. 13. The detecting part 55 does not have the transport blade 51 and the agitator 58 on the rotary shaft 50, except for the cleaning member 39 that cleans the end surfaces of the first and second light guiding members 36 and 37 disposed facing each other in the detection area E. The cleaning member 39 as well as the transport blade 51 is attached to rotary shaft 50 by inserting claws into respective coupling holes.

The downstream transport facilitating part 56 is located downstream from the detection area E in the powder transport direction, as illustrated in FIG. 13. The downstream transport facilitating part 56 includes the transport blade 51 over the whole outer circumference of the rotary shaft 50. According to this configuration, the downstream transport facilitating part 56 transports the toner at a speed faster than the transport decelerating part 54.

The transport reversing part 57 includes the transport blade 51 rotating in reverse to the other parts of the first toner transport screw unit 29, so that the toner is transported in an opposite direction to the powder transport direction, which is also referred to as a main transport direction, in the transport reversing part 57. The transport reversing part 57 is located downstream from the openings 31*a* through which the toner is conveyed between the developer container section 32 and the development section 33, as illustrated in FIG. 13. In the present embodiment, the transport reversing part 57 includes the transport blade 51 over the whole circumference of the rotary shaft 50.

Now a description is given of detailed actions performed by and effects achieved by the first toner transport screw unit 29 as illustrated in FIGS. 12 and 13.

The toner supplied from the inlet 25*a* to the developer container section 32 is transported by the upstream transport facilitating part 52 to the downstream side in the powder transport direction. The upstream transport facilitating part 52 including the transport blade 51 over the whole outer circumference of the rotary shaft 50 transports the toner faster than the transport decelerating part 54. Transporting the toner faster by the upstream transport facilitating part 52 is to facilitate toner transport in the vicinity of the inlet 25*a*, so that the toner may not fall out from the inlet 25*a*.

The toner is then transported to the transport decelerating part 54. Since the transport decelerating part 54 transports the toner at the speed slower than the upstream transport facilitating part 52, the toner transport is forcedly delayed. By decelerating and delaying toner transport in the transport decelerating part 54, the toner remains before the detection area E to supply the toner to the detection area E reliably. Since no agitator blade 58 is provided at the downstream side of the transport decelerating part 54 in the powder transport direction, irregularities in toner distribution in the developer container section 32 due to rotation of the agitator blade 58 can be prevented in the vicinity of the upstream side of the detection area E in the powder transport direction. As a result, detection accuracy in the present toner level A1 in the detection area E can be enhanced.

In the agitating part 53 included the transport decelerating part 54, the agitating blade 58 attached to the rotary shaft 50 agitates and transports the toner. Similar to the development device 4 according to the previous embodiment, the toner circulates between the developer container section 32 and the development section 33 in the development device 4A according to the present embodiment. Therefore, unused toner in the development area (toner using area) where the toner is transported from the development roller 26 to the photoconductor 2 is returned to the development section 33 and conveyed to the inlet 25*a*, as illustrated in FIG. 13. Consequently, the development device 4 contains non-new toner remaining unused in the development area and returned to the portion facing the inlet 25*a* and new toner newly supplied from the inlet 25*a* together. However, if the non-new toner and the new toner are not mixed sufficiently, the toner in the development device 4 is not charged uniformly, causing color irregularity and/or background contamination to degrade image quality.

In the present embodiment, the toner is agitated in the agitating part 53. Accordingly, the non-new toner and the new toner can be sufficiently mixed in a toner pathway from the inlet 25*a* to a development area, thereby preventing image quality deterioration.

The toner is then transported from the transport decelerating part 54 to the detecting part 55. Since the detecting part 55 does not include any transport blades and agitators, toner transport and agitation are not performed actively. According to this configuration, the toner can be retained and toner irregularities can be prevented, thereby enhancing the detection accuracy in the present toner level in the detection area E.

Then the toner is transported to the downstream transport facilitating part 56. With the transport blade 51 provided over the whole outer circumference of the rotary shaft 50, the toner is transported at the speed faster than the transport decelerating part 54. Transporting the toner at the faster speed in the downstream transport facilitating part 56 prevents misdetection due to excess delay of toner in the detection area E.

The toner transported to the downstream side of the downstream transport facilitating part 5 comes to the development section 33 via the openings 31*a* of the partition 31.

In the transport reversing part 57 located downstream from the downstream transport facilitating part 56 in the powder transport direction, the toner is transported in the opposite direction. According to this configuration, the toner moving opposite directions meets the location facing the opening 31*a*, so that the toner can be exited easily from the opening 31*a* to the development section 33. In addition, returning the toner by the transport reversing part 57 can prevent toner aggregation at the downstream end of the developer container section 32 in the powder transport direction.

As described above, the first toner transport screw unit 29 illustrated in FIGS. 13 and 14 can function and provide such effects as a result. However, the first toner transport screw unit 29 and a control of the amount of toner supply can be employed at the same time. The configuration of the image forming apparatus that can apply the first toner transport screw unit 29 is not limited to the configuration as illustrated in FIG. 13. For example, the first toner transport screw unit 29 is applicable to an image forming apparatus (e.g., the image forming apparatus 100) including a toner cartridge (e.g., the toner cartridge 41) with a shutter (e.g., the shutter 48) as illustrated in FIG. 9 or an image forming apparatus (e.g., the image forming apparatus 100) including multiple toner cartridges (e.g., the toner cartridges 41Y, 41M, 41C, and 41K) that are removably installable to the image forming apparatus according to open/close of a cover (e.g., the cover 101) as illustrated in FIGS. 11 and 12.

Further, the image forming apparatuses 100, 100A, and 100B according to the above-described embodiments are not limited to a color laser printer but can be other types of printers, copiers, facsimile machines, or multifunctional machines including at least two functions of the printers, copiers, and facsimile machines.

Further, one-component developer including toner is used in the above-described embodiments. However, the developer is not limited thereto. For example, a two-component developer including carrier and toner can also perform the same function and achieve the same effect as the above-described developer.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

a powder container to contain powder used for image forming and including an inlet through which the powder is supplied;

a powder supply unit including an outlet that is removably connected to the inlet, the powder supply unit supplying the powder to the powder container with the outlet connected to the inlet of the powder container;

a powder amount detector to detect whether a present powder level in the powder container is equal to or greater than a threshold;

a controller to control an amount of powder supplied from the powder supply unit, the controller controlling the present powder level in the powder container after replenishment to maintain in a range from the threshold to a position corresponding to an upper edge of the inlet; and a powder consumption detector to detect an amount of powder consumption in the powder container, wherein the controller performs a first control in which the powder supply unit supplies an amount of powder less than the amount of powder consumption based on the amount of powder consumption detected by the powder consumption detector upon the powder amount detector detecting that the present powder level in the powder container is equal to or greater than the threshold, wherein the controller performs a second control in which the powder supply unit supplies a given amount of powder upon the powder amount detector detecting that the present powder level in the powder container is less than the threshold, wherein the given amount of powder in the second control is previously adjusted so that the present powder level in the powder container after replenishment is maintained in the range from the threshold to the position corresponding to the upper edge of the inlet.

2. An image forming apparatus comprising:

a powder container to contain powder used for image forming and including an inlet through which the powder is supplied;

a powder supply unit including an outlet that is removably connected to the inlet, the powder supply unit supplying the powder to the powder container with the outlet connected to the inlet of the powder container;

a powder amount detector to detect whether a present powder level in the powder container is equal to or greater than a threshold; and a controller to control an amount of powder supplied from the powder supply unit, the controller controlling the present powder level in the powder container after replenishment to maintain in a range from the threshold to a position corresponding to an upper edge of the inlet, wherein at least one of the inlet and the outlet includes a shutter to open and close the at least one thereof.

3. An image forming apparatus comprising:

a powder container to contain powder used for image forming and including an inlet through which the powder is supplied;

a powder supply unit including an outlet that is removably connected to the inlet, the powder supply unit supplying the powder to the powder container with the outlet connected to the inlet of the powder container;

a powder amount detector to detect whether a present powder level in the powder container is equal to or greater than a threshold;

a controller to control an amount of powder supplied from the powder supply unit, the controller controlling the present powder level in the powder container after replenishment to maintain in a range from the threshold to a position corresponding to an upper edge of the inlet; and a cover rotatably attached thereto, wherein the powder container includes multiple powder containers and the powder supply unit includes multiple powder supply units, wherein the multiple powder supply units are integrally provided in the cover, to be attached to or detached from the inlet of each of the multiple powder containers, wherein the outlet of the multiple powder supply units is attached to or detached from the inlet of the multiple powder containers according to opening and closing of the cover.

4. A powder transport unit, comprising:

a transport decelerating part upstream from a detection area in a powder transport direction to decelerate a speed of powder transport, the detection area to accommodate a powder amount detector of an image forming apparatus to detect whether a present powder level supplied in a powder container provided in the image forming apparatus is equal to or greater than a threshold; and an upstream transport facilitating part located facing an inlet provided in the image forming apparatus for supplying a powder for image forming to the powder container, the upstream transport facilitating part transporting the powder at a speed faster than the transport decelerating part.

5. The powder transport unit according to claim 4, further comprising:

a rotary shaft disposed inside the powder container; and a helical transport blade disposed on an outer circumference of the rotary shaft, wherein the upstream transport facilitating part includes the helical transport blade over the whole outer circumference of the rotary shaft.

6. The powder transport unit according to claim 5, wherein an agitating part is a part of the transport decelerating part, wherein the transport decelerating part extends longer than the agitating part toward a downstream side of the rotary shaft in the powder transport direction.

7. The powder transport unit according to claim 6, further comprising:

a downstream transport facilitating part provided downstream from the detection area in the powder transport direction;

a rotary shaft disposed inside the powder container; and a helical transport blade disposed on an outer circumference of the rotary shaft, wherein the downstream transport facilitating part includes the helical transport blade over the whole outer circumference of the rotary shaft.

8. The powder transport unit according to claim 4, further comprising an agitating part to agitate new powder supplied from an inlet provided in the image forming apparatus for supplying powder for image forming to the powder container and non-new powder unused in a development area in the image forming apparatus for developing a visible image and returned to a portion facing the inlet in a range of from the inlet to the development area.

9. The powder transport unit according to claim 8, further comprising:

a rotary shaft disposed inside the powder container; and a helical transport blade disposed on an outer circumference of the rotary shaft, wherein the agitating part includes a planar agitator blade arranged on the rotary shaft.

10. The powder transport unit according to claim 4, further comprising a downstream transport facilitating part located downstream from the detection area in the powder transport direction to transport powder at a speed faster than the transport decelerating part.

11. The powder transport unit according to claim 4, further comprising:

a rotary shaft disposed inside the powder container; and a helical transport blade disposed on an outer circumference of the rotary shaft, wherein the transport decelerating part includes the helical transport blade over a part of the outer circumference of the rotary shaft.

12. The powder transport unit according to claim 4, further comprising:

a detecting part located facing the detection area;

a rotary shaft disposed inside the powder container; and a cleaning member attached to the rotary shaft to clean the detection area, wherein the detecting part includes the cleaning member.

* * * * *